US007275552B2

(12) United States Patent
DeWeerd et al.

(10) Patent No.: US 7,275,552 B2
(45) Date of Patent: Oct. 2, 2007

(54) DISHWASHER WITH BULK WASH AID DISPENSER

(75) Inventors: Brent A. DeWeerd, St. Joseph, MI (US); Thomas Haft, Coloma, MI (US); Jeff M. Borah, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 511 days.

(21) Appl. No.: 10/734,334

(22) Filed: Dec. 13, 2003

(65) Prior Publication Data

US 2005/0126608 A1 Jun. 16, 2005

(51) Int. Cl.
*B08B 3/02* (2006.01)

(52) U.S. Cl. ..... 134/93; 68/17 R; 137/268

(58) Field of Classification Search ..... 134/93; 137/268; 68/17 R
See application file for complete search history.

(56) References Cited

U.S. PATENT DOCUMENTS

| | | | | |
|---|---|---|---|---|
| 4,687,121 | A * | 8/1987 | Copeland | 222/64 |
| 4,808,236 | A | 2/1989 | Davis, Jr. | |
| 5,133,487 | A * | 7/1992 | Russi | 222/651 |
| 5,186,912 | A | 2/1993 | Steindorf et al. | |
| 5,261,432 | A * | 11/1993 | Sandrin | 134/93 |
| 5,389,344 | A * | 2/1995 | Copeland et al. | 422/264 |
| 5,413,259 | A | 5/1995 | Cerruti et al. | |
| 5,593,648 | A * | 1/1997 | Christie et al. | 422/266 |
| 5,603,431 | A * | 2/1997 | Tuller | 222/63 |
| D393,333 | S | 4/1998 | Kibler et al. | |
| 5,849,253 | A * | 12/1998 | Crossdale et al. | 422/264 |
| 6,418,943 | B1 | 7/2002 | Miller | 134/104.1 |
| 6,701,944 | B2 * | 3/2004 | McNabb et al. | 134/93 |
| 6,773,668 | B1 * | 8/2004 | Everson et al. | 422/28 |
| 7,047,987 | B2 * | 5/2006 | Cerruti et al. | 134/58 D |
| 2003/0168085 | A1 * | 9/2003 | Sowle et al. | 134/25.2 |
| 2005/0000551 | A1 * | 1/2005 | McIntyre et al. | 134/56 D |
| 2005/0121058 | A1 * | 6/2005 | Furber et al. | 134/93 |

FOREIGN PATENT DOCUMENTS

| | | |
|---|---|---|
| DE | 35 13 640 | * 10/1986 |
| JP | 2000-185008 | * 7/2000 |

* cited by examiner

*Primary Examiner*—Frankie L. Stinson
(74) *Attorney, Agent, or Firm*—Michael D. Lafrenz; John W. Morrison

(57) ABSTRACT

A dishwasher comprises a bulk wash aid dispenser than can store both solid and liquid bulk wash aids and dispense controllable amounts therefrom during dishwashing cycles. The controllable amounts are typically single charges, the amount required during a selected dishwashing cycle. The single charges can be dispensed individually or simultaneously and all at once or at various intervals.

37 Claims, 6 Drawing Sheets

DISHWASHER WITH BULK WASH AID DISPENSER

BACKGROUND OF THE INVENTION

1. Field of the Invention

The invention relates to dishwashers. In one aspect, the invention relates to a dishwasher with a bulk wash aid dispenser. In another aspect, the invention relates to a bulk wash aid dispenser for use in a dishwasher.

2. Description of the Related Art

Most automated household dishwashers for cleaning utensils, such as dishes, plates, bowls, glassware, pots and pans, and silverware, have a dispenser for storing and releasing a single or individual charge of one or more wash aids, such as detergents, rinse aids, and film removers, at appropriate times during a dishwashing cycle. Typically, the volume of an individual charge of a wash aid is released all at once into the wash chamber. Because the dispenser holds only a single charge of each wash aid, the user must provide new individual charges of the wash aids at the beginning of each dishwashing cycle. This procedure is inconvenient for the user who must remember to supply the wash aids and spend time refilling the appropriate dispensers. Furthermore, the amount of wash aid introduced into the dispensers is dependent on the user. Although the dispenser can have fill level indicators, users can ignore the recommendations and use either too much or too little wash aid. Improper quantities of wash aid can deposit residue and films or inadequately clean the utensils.

The single-charge dispensers also prevent the use of more complex dishwashing cycles, which can provide for better overall cleaning. For example, depending on the soil load on the utensils, it can be beneficial to release a portion of the single charge at different times during the dishwashing cycle, rather than releasing all of the single charge at the same time. Similarly, it can be beneficial to have dishwashing cycles with multiple wash cycles interspersed with multiple rinse cycles. Each of the wash and rinse cycles could use different amounts of wash aid. The amounts of wash aid could be more than or less than a single charge, and the wash aid could be dispensed all at once or in portions of the total wash aid. Single charge dispensers cannot effect these more complex dishwashing cycles.

The problems associated with single-use wash aids in dishwashers are remedied by bulk wash aids. In general, a bulk wash aid is a solid or liquid agglomeration of multiple charges of a wash aid for use in multiple dishwashing cycles. When this form of wash aid is employed, the user does not have to replace it between each use of the dishwasher nor determine the quantity of wash aid in the dishwasher liquid solution. Rather, a bulk wash aid dispenser meters the amount of wash aid supplied to the solution.

Some household dishwashers have bulk wash aid dispensers that continuously expose the bulk wash aid supply to the recirculating liquid in the dishwasher. Because the bulk wash aid is constantly in fluid communication with the liquid, it is difficult to properly meter an accurate charge of detergent. Additionally, dishwashers can utilize a rinse cycle wherein no wash aid is desired, but dishwashers with such bulk wash aid dispensers are not able to cease the release of wash aid into the rinse liquid. Furthermore, some bulk wash aid dispensers can only accommodate solid bulk wash aids; however, it is often desirable to utilize both solid and liquid wash aids during a dishwashing cycle.

SUMMARY OF THE INVENTION

In one of its aspects, the invention is an automatic household dishwasher for washing utensils in accordance with a user selected dishwashing cycle comprises a wash tub having top, bottom, side and rear walls, with the walls collectively forming an open-faced wash chamber for receiving utensils to be washed, and a moveably mounted door movable between an opened position for providing access to the wash chamber and a closed position for selectively closing the open-face of the wash chamber during the dishwashing cycle. The dishwasher further comprises a bulk wash aid dispenser for storing a supply of wash aid greater than that needed for a single dishwashing cycle and supplying the amount of wash aid required for the single dishwashing cycle.

The bulk wash aid dispenser dispenses a variable amount of wash aid depending on the dishwashing cycle selected by the user. The bulk wash aid dispenser dispenses the variable amount of wash aid in multiple charges of a predetermined amount, and the multiple charges are dispensed at different times throughout the dishwashing cycle.

The dispenser further comprises a controller for executing the selected dishwashing cycle and controlling the dispensing of the multiple charges in response to the selected dishwashing cycle. The controller comprises a user interface through which a user can select one of several dishwashing cycles.

The bulk wash aid dispenser dispenses multiple wash aids, and at least one of the multiple wash aids is one of a solid and liquid. The multiple wash aids can include a solid wash aid and a liquid wash aid.

The bulk wash aid dispenser further comprises a solid wash aid chamber for storing a solid wash aid, and the solid wash aid chamber is keyed to receive a predetermined solid wash aid. The solid wash aid chamber has an insert opening of a predetermined shape to form the keyed chamber, and the insert opening is one of a tri-lobe and a D-shape configuration. The bulk wash aid dispenser further comprises a spray nozzle directed onto the solid wash aid chamber such that water exiting the spray nozzle dissolves the solid wash aid to effect the dispensing of the solid wash aid.

The bulk wash aid dispenser also comprises a liquid wash aid area for storing a liquid wash aid. The liquid wash aid area comprises a replaceable cartridge containing the liquid wash aid, and the liquid wash aid area comprises a pump fluidly connected to the replaceable cartridge for pumping the liquid wash aid from the replaceable cartridge into the wash chamber.

The bulk wash aid dispenser comprises a housing mounted to an inner surface of the door, and the housing defines a bulk wash aid storage area. A dispenser door moveably mounted to the housing selectively closes the bulk wash aid storage area. A bulk wash aid carrier is mounted to an inner surface of the dispenser door and defines a chamber for receiving a bulk supply of wash aid. A spray nozzle is located within the housing to direct liquid spray into the chamber to effect the dispensing of the bulk wash aid stored therein. The carrier comprises an insert opening of a predetermined shape to permit the insertion of a bulk supply of wash aid having a configuration corresponding to the predetermined shape of the insert opening. The insert opening is one of a tri-lobe and a D-shape configuration. The bulk wash aid carrier also comprises a second insert opening having a second predetermined shape.

The bulk wash aid dispenser further comprises a cartridge containing a bulk supply of liquid wash aid, with the cartridge being placed within the bulk wash aid storage area. A pump fluidly coupled to the cartridge dispenses the liquid wash aid from the cartridge.

In another of its aspects, the invention is a bulk wash aid dispenser for an automatic household dishwasher for washing utensils in accordance with a user selected dishwashing cycle. The bulk wash aid dispenser comprises a housing defining a bulk wash aid storage area, a dispenser door moveably mounted to the housing moveable between an opened position and a closed position for selectively closing the bulk wash aid storage area, and a bulk wash aid carrier mounted to an inner surface of the dispenser door and defining a chamber for receiving a bulk supply of wash aid which is accessible when the dispenser door is in the open position to permit the filling of the chamber with the wash aid. The bulk wash aid dispenser stores a supply of wash aid greater than that needed for a single dishwashing cycle in the chamber and supplies the amount of wash aid required for the single dishwashing cycle.

The bulk wash aid dispenser further comprises a spray nozzle located within the housing to direct liquid spray into the chamber to effect the dispensing of the bulk wash aid stored therein.

The bulk wash aid carrier comprises an insert opening of a predetermined shape to permit the insertion of a bulk supply of wash aid having a configuration corresponding to the predetermined shape of the insert opening, and the insert opening is one of a tri-lobe or a D-shape configuration. The bulk wash aid carrier further comprises a second insert opening having of a second predetermined shape.

The bulk wash aid dispenser further comprises a cartridge containing a bulk supply of liquid wash aid, with the cartridge being placed within the bulk wash aid storage area. A pump fluidly coupled to the cartridge dispenses the liquid wash aid from the cartridge.

The bulk storage area is divided into a solid wash aid area and a liquid wash aid area. The spray nozzle is located in the solid wash aid area and the pump is located in the liquid wash aid area. A first door element selectively covers the solid wash aid area, and a second door element selectively covers the liquid wash aid area.

In yet another of its aspects, the invention is a bulk wash aid dispenser for an automatic household dishwasher for washing utensils in accordance with a user selected dishwashing cycle. The bulk wash aid dispenser comprises a housing defining a bulk wash aid storage area for a block of solid wash aid and a key provided on the housing such that only blocks of solid wash aid having a shape complementary to the key can be received within the bulk wash aid storage area.

The bulk wash aid comprises an insert opening to the bulk wash aid storage area, and the insert opening has a predetermined shape that forms the key. The insert opening can be multi-lobe configuration, and the multi-lobe configuration can be a tri-lobe configuration. The insert opening can be a D-shape configuration. The bulk wash aid dispenser further comprises a block of solid wash aid having a shape that is complementary to the key.

The bulk wash aid dispenser further comprises a dispenser door moveably mounted to the housing for movement between an opened position and a closed position to provide access to the bulk wash aid storage area, and the key is carried by the dispenser door.

DESCRIPTION OF THE INVENTION

The invention address the deficiencies of the prior art and provides a bulk wash aid dispenser that stores both solid and liquid bulk wash aids, which are agglomerations of multiple charges of a wash aid for use in multiple dishwashing cycles, and dispenses controllable quantities of the wash aids when desired during a dishwashing cycle, which can include several individual cycles, such as a soak cycle, a rinse cycle, and a wash cycle.

Figure 1:
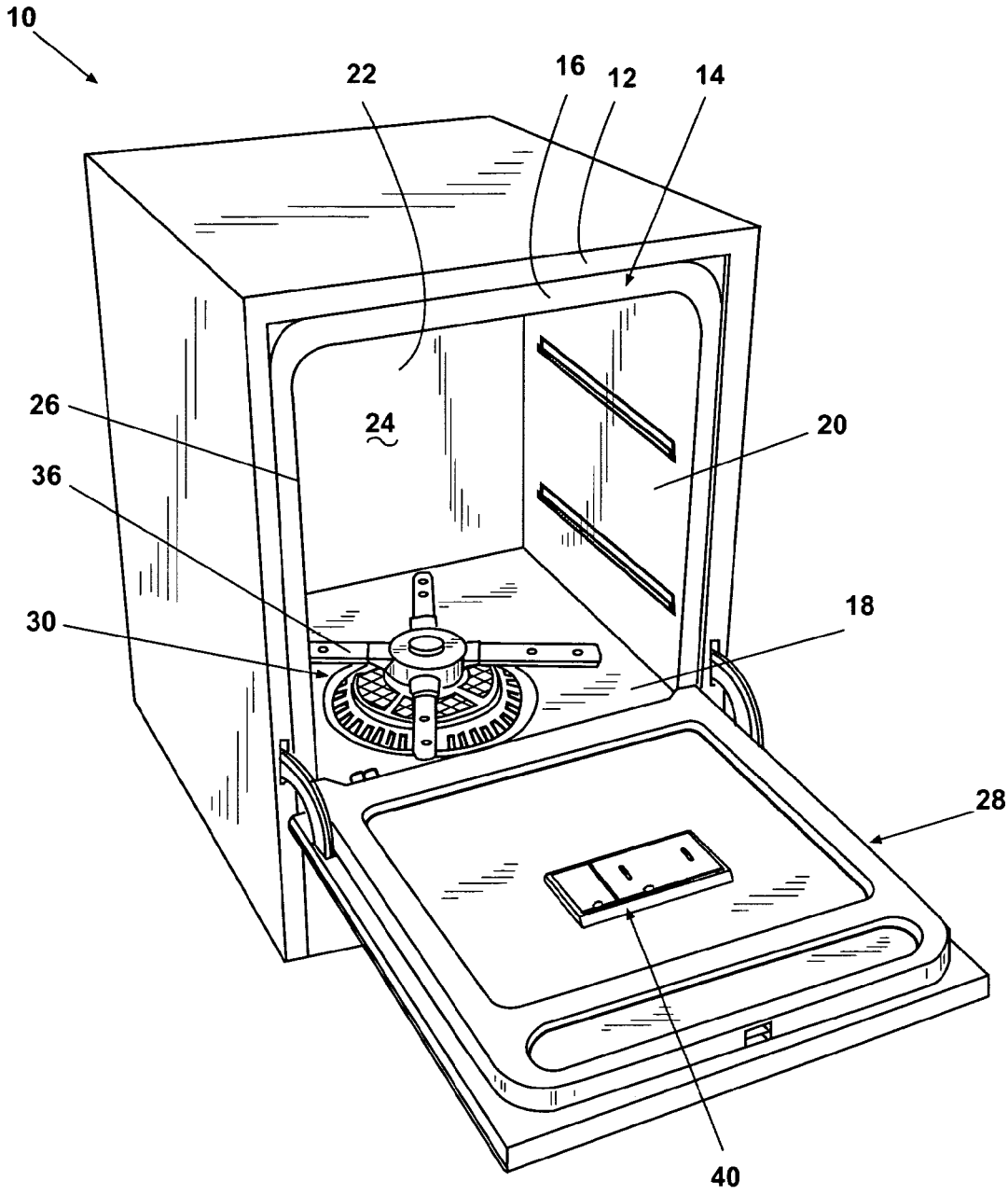
FIG. 1 is perspective view of an automatic household dishwasher with a bulk wash aid dispenser according to the invention.

Referring now to the figures and to FIG. 1 in particular, a typical automated dishwasher 10 comprises a housing 12 for a wash tub 14. The wash tub 14 has spaced top and bottom walls 16 and 18, spaced side walls 20 generally orthogonal to the top and bottom walls 16 and 18, and a rear wall 22 substantially orthogonal to the top and bottom walls 16 and 18 and to the side walls 20. The walls 16, 18, 20, and 22 join along their respective edges to define a wash chamber 24 with an open face 26. Utensils, such as plates, bowls, silverware, glassware, pots, pans, and the like, are received in the wash chamber 24 during a dishwashing cycle.

Figure 5:
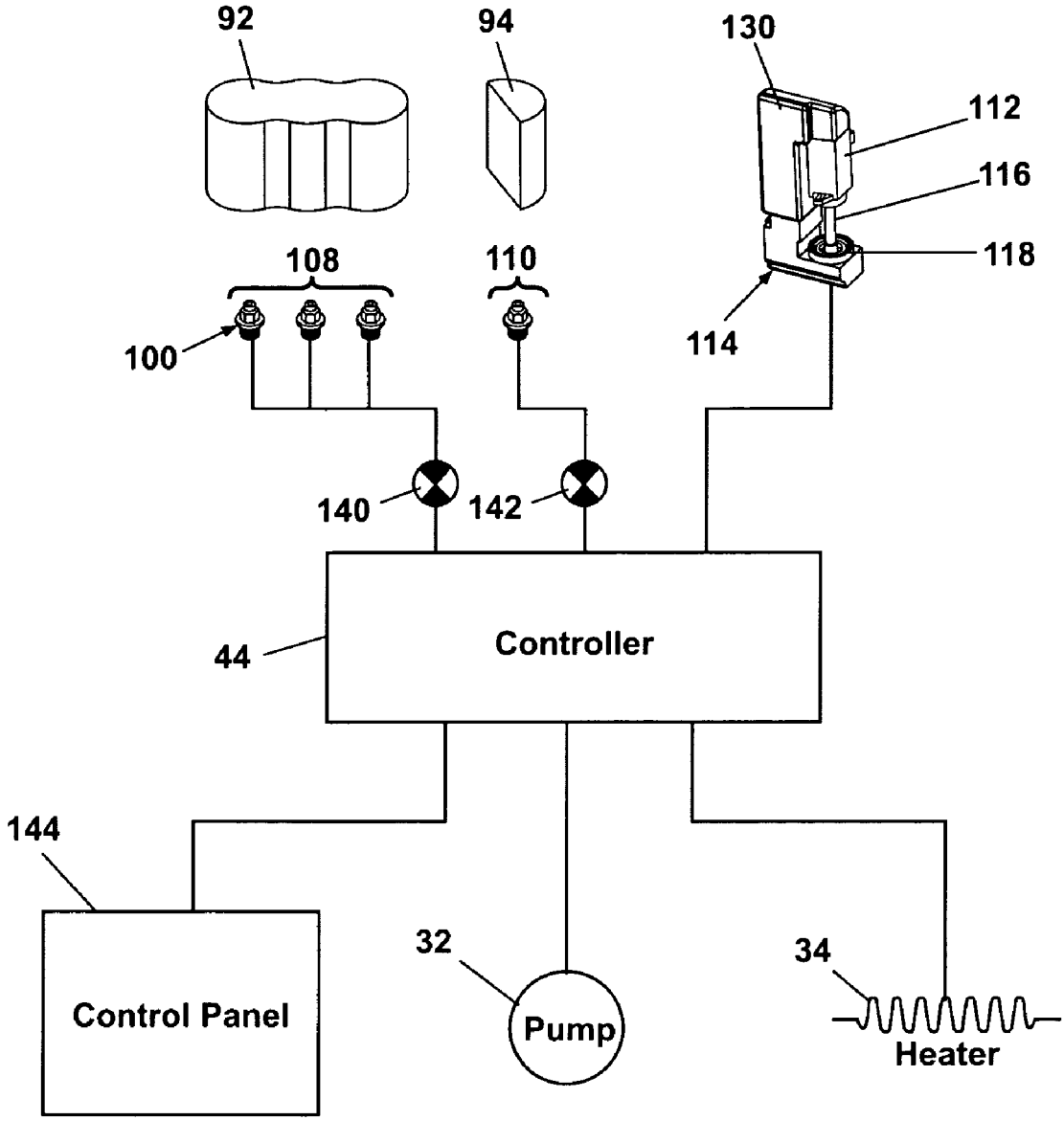
FIG. 5 is a schematic of a wash aid dispensing system, which includes the bulk wash aid dispenser and a liquid circulation system, of the automatic household dishwasher from FIG. 1.

Additionally, the dishwasher 10 comprises a liquid circulation system 30 for introducing and circulating liquid and wash aids, such as detergents, rinse aids, and the like, throughout the wash chamber 24. The liquid circulation system 30 includes, among other components, a pump 32 and at least one spray arm 36 for propelling liquid through the liquid circulation system 30 and a heater 34 for heating the liquid. The pump 32 and heater 34 are shown in FIG. 5, which is a schematic of a wash aid dispensing system that includes the liquid circulation system 30. The features of liquid recirculation systems are well known and are not germane to the invention; therefore, they will not be described in further detail. An example of a liquid circulation system is provided in U.S. Pat. No. 6,418,943, which is incorporated herein by reference in its entirety.

A door 28 is hingedly mounted to the dishwasher 10 and can move between an opened position, as illustrated in FIG. 1, to provide access to the wash chamber 24 and a closed position (not shown) to close the wash chamber 24 by covering the open face 26 of the wash chamber 24. Typically, the door 28 is in the opened position when utensils are loaded or unloaded into the dishwasher and in the closed position while the dishwashing cycle is running or while the dishwasher 10 is not in use. A bulk wash aid dispenser 40 is mounted on an inside surface of the door 28 such that the bulk wash aid dispenser 40 is disposed in the wash chamber 24 when the door 28 is in the closed position.

Figure 2:
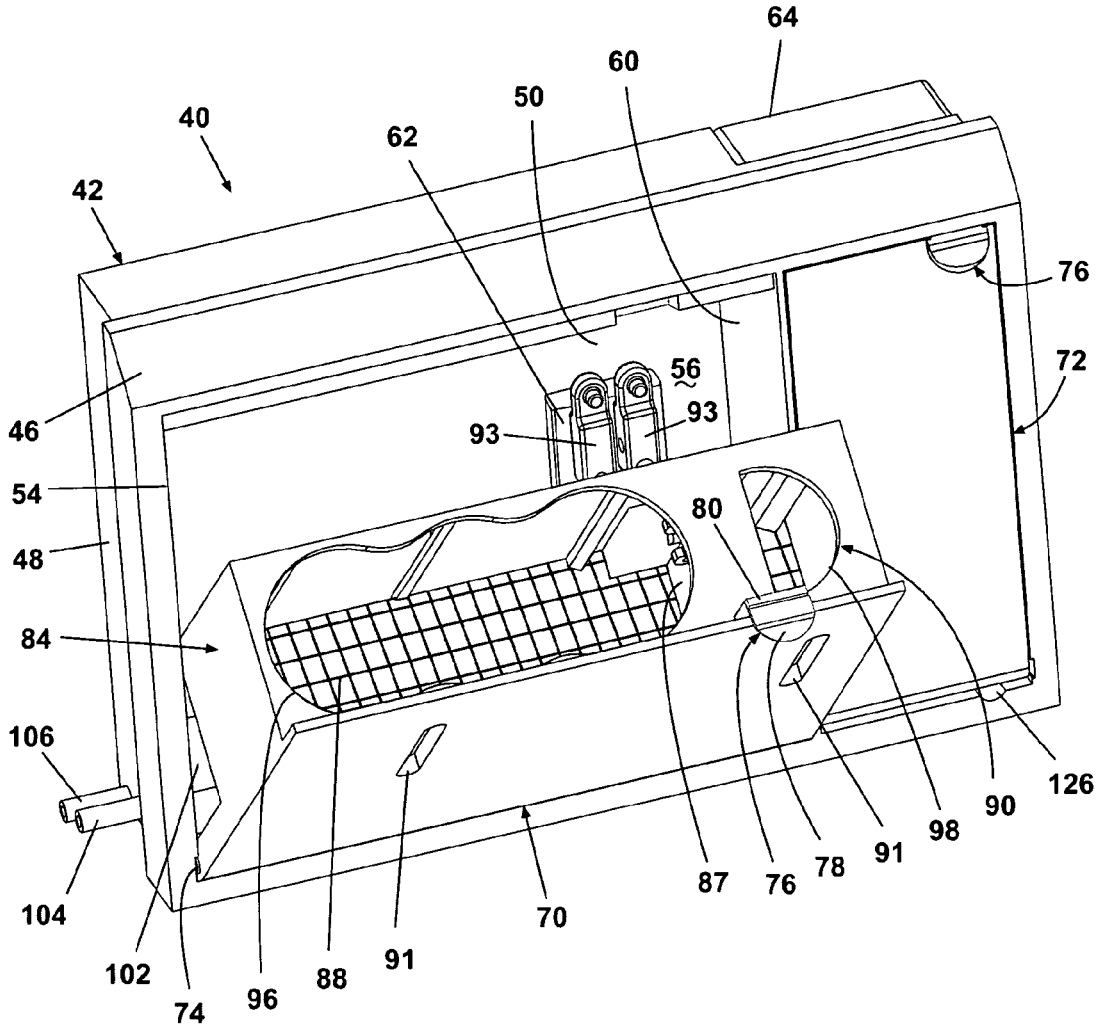
FIG. 2 is a perspective view of the bulk wash aid dispenser from FIG. 1 and comprising a housing with a solid wash aid area and a liquid wash aid area, door elements to selectively close the solid and liquid wash aid areas, and a bulk wash aid carrier on the door element for the solid wash aid area, wherein the bulk wash aid carrier has a tri-lobe insert opening and a D-shaped insert opening.
Figure 3:
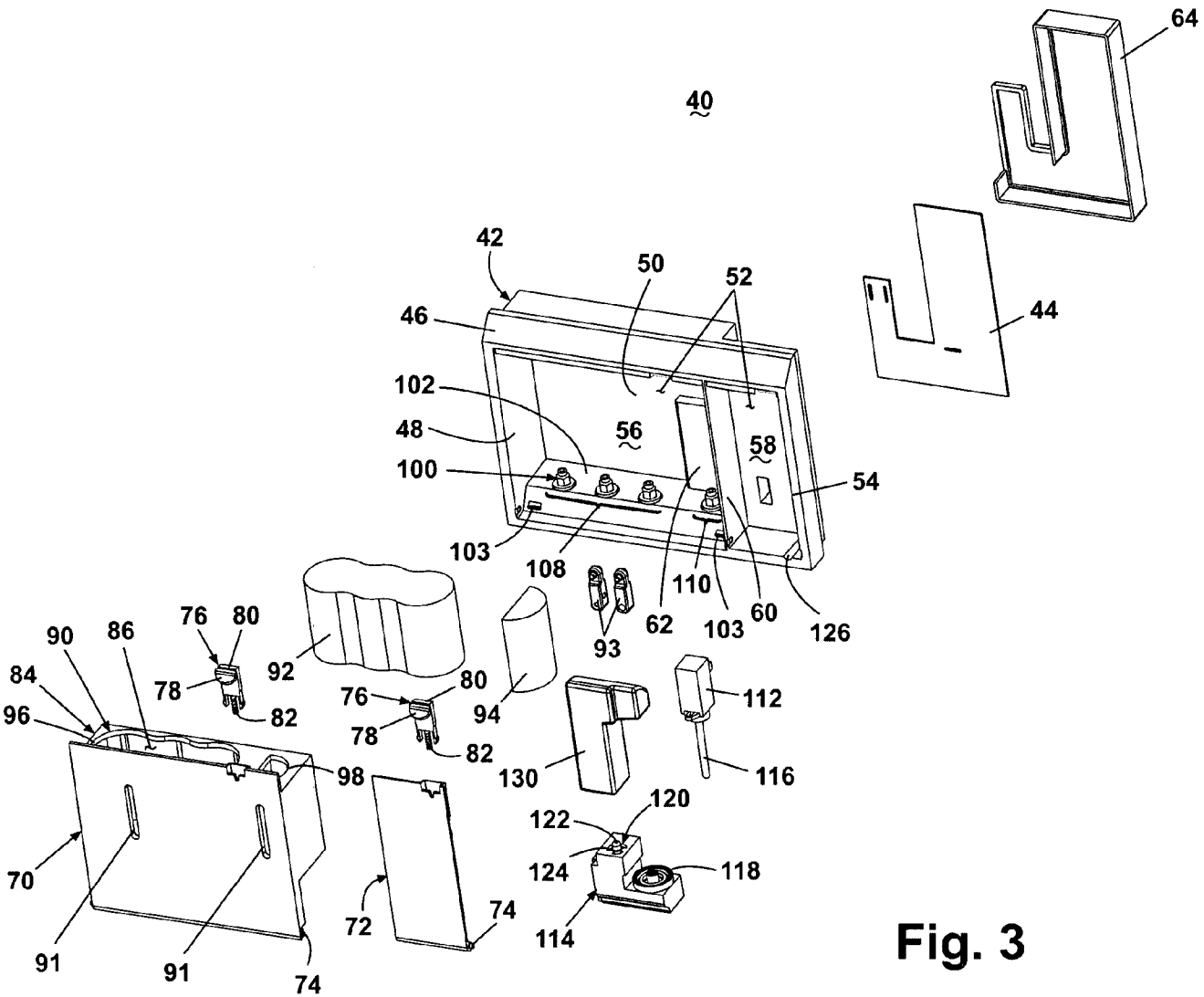
FIG. 3 is an exploded view of the bulk wash aid dispenser from FIG. 2 and including a tri-lobe solid bulk wash aid, a D-shaped solid bulk wash aid, and a cartridge of a liquid bulk wash aid.
Figure 4:
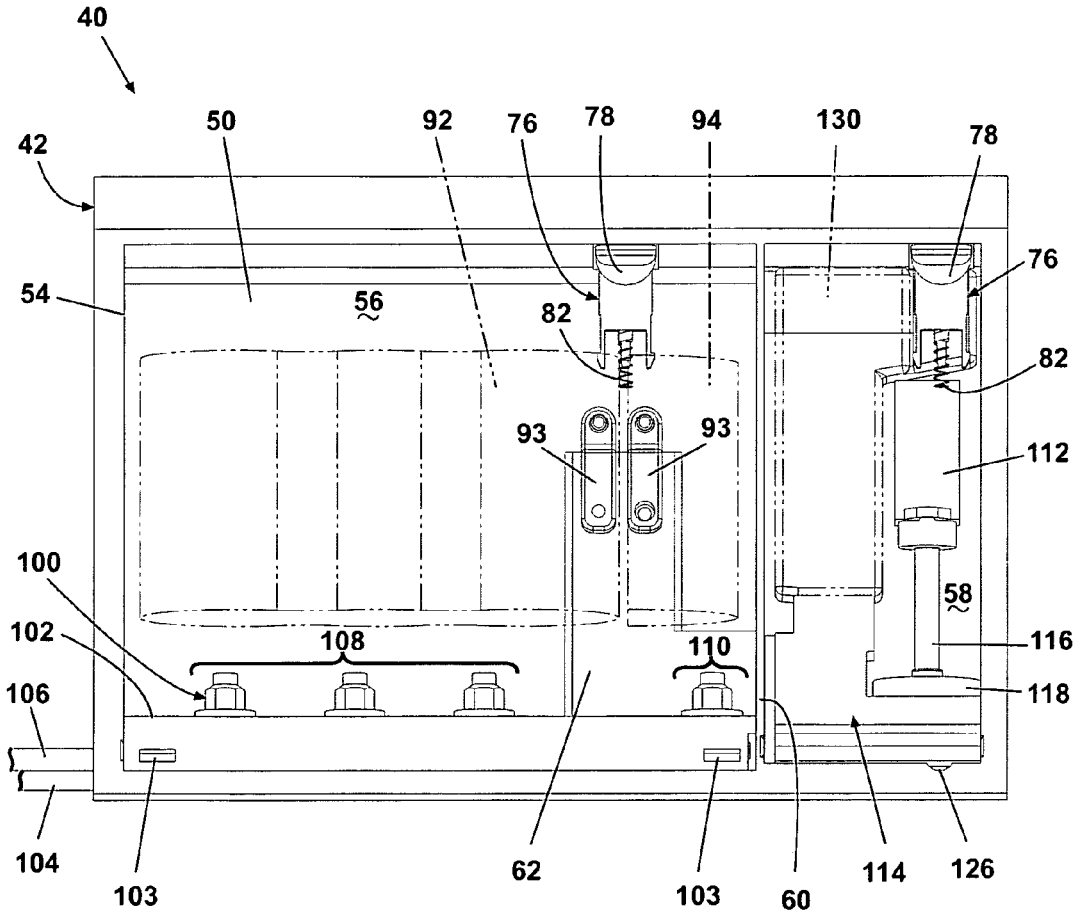
FIG. 4 is front elevational view of the bulk wash aid dispenser from FIG. 2 without the door elements and wherein the tri-lobe solid bulk wash aid, the D-shaped solid bulk wash aid, and the cartridge of a liquid bulk wash aid are shown in phantom.

Referring now to FIGS. 2-4, the bulk wash aid dispenser 40 comprises a housing 42 having a beveled front frame 46, a peripheral wall 48, and a rear wall 50. When the bulk wash aid dispenser 40 is mounted to the door 28, the peripheral wall 48 and the rear wall 50 preferably reside inside the door 28, and at least a portion of the front frame 46 extends beyond the inside surface of the door 28. The housing 42 forms a bulk wash aid storage area 52 with an open face 54. The bulk wash aid storage area 52 is separated into a solid wash aid area 56 and a liquid wash aid area 58 by a divider wall 60. The rear wall 50 forms an irregularly shaped and inwardly extending recess 62 that is sized to receive a controller 44, which is illustrated in FIG. 3 as a circuit board with an irregular shape similar to that of the recess 62. A cover 64 is disposed over the recess 62 on the rear side of the housing 42 to protect the controller 44. Together, the cover 64 and the rear wall 50 form a planar surface.

A dispenser door, which comprises a first door element 70 and a second door element 72, selectively closes the open-faced bulk wash aid storage area 52. Specifically, the first and second door elements 70, 72 are adjacent the solid and liquid wash aid areas 56, 58, respectively. Both of the door elements 70, 72 are pivotally mounted to the housing 42 by pivot pins 74, preferably near the lower end of the solid and liquid wash aid areas 56, 58, and can be moved between an opened position to provide access to the bulk wash aid storage area 52 and a closed position to cover the open face 54 of the bulk wash aid storage area 52. The first door element 70 is positioned such that a small clearance exists between the lower end of the first door element 70 and the frame 46 at least when the first door element 70 is in the closed position.

Each door element 70, 72 is secured in the closed position by a latch 76. The latch 76 comprises a finger tab 78 and a ledge 80 and is biased towards the front frame 46, as shown in FIG. 4, by a spring 82 when the door element 70, 72 is in the closed position. As a result of the spring bias, the ledge 80 is retained by the front frame 46. To open the door element 70, 72, force applied to the finger tab 78 and against the bias of the spring 82 releases the ledge 80 from the front frame 46 and pivots the door element 70, 72 about the pivot pins 74. Latches for securing door elements of detergent dispensers are well known in the art, and it is within the scope of the invention to utilize other types of latches to secure the door elements 70, 72 in the closed position.

The first door element 70 further comprises a bulk wash aid carrier 84 mounted to an inner surface thereof. The height of the bulk wash aid carrier 84 is less than the height of the first door element 70 and is disposed near the top of the first door element 70. The bulk wash aid carrier 84 defines a chamber 86 sized to hold at least one bulk wash aid, preferably solid bulk wash aids having a predetermined shape. In the embodiment shown in FIGS. 2-4, the solid bulk wash aids are a tri-lobe solid bulk wash aid 92 and a D-shaped solid bulk wash aid 94. An internal wall 87 inside bulk wash aid carrier 84 prevents fluid communication between the regions of the chamber 86 that house the solid bulk wash aids 92, 94.

The bulk wash aid carrier 84 has a supporting grid 88 at one end and insert openings 90 through the opposite end. The insert openings 90 have the same predetermined shape as the solid bulk wash aids 92, 94. Correspondingly, the insert openings 90 in the embodiment shown in FIGS. 2-4 are a tri-lobe opening 96 and a D-shape opening 98. The solid bulk wash aids 92, 94 can be inserted through the insert openings 90 and into the chamber 86 when the first door element 70 is in the opened position. The insert openings 90 function as a key to ensure that each solid bulk wash aid 92, 94 is in its correct location in the chamber 86.

Windows 91 through the first door element 70 provide visual access to the solid bulk wash aids 92, 94 when the first door element 70 is in the closed position so that a user can determine if either of the solid bulk wash aids 92, 94 need to be replaced without having to open the first door element 70. Additionally, the bulk wash aid dispenser 40 comprises a system for providing a visual indication, such as a light (not shown) on the bulk wash aid dispenser 40 or on the door 28, or an audio signal to inform a user that the volume of one or both of the solid bulk wash aids 92, 94 is below a predetermined volume and needs replenishing. Optionally, the signal can indicate to the user an estimated number of wash cycles for which the solid bulk wash aid 92, 94 will last. The system includes proximity switches having magnets 93 that are in communication with the chamber 86 when the first door element 70 is in the closed position. In particular, the magnets are in communication with the regions of the chamber 86 in which the solid bulk wash aids 92, 94 reside. When either of the solid bulk wash aids 92 or 94 is reduced to the predetermined volume, the corresponding magnet 93 trips its proximity switch, which subsequently activates the visual or audio signal.

A liquid dispensing system for spraying liquid, preferably water, onto the solid bulk wash aids 92, 94 is disposed within the solid wash aid area 56. The liquid dispensing system comprises a plurality of liquid spray nozzles 100 disposed on a platform 102, a manifold system (not shown), and first and second inlet conduits 104, 106. The spray nozzles 100 are mounted on the platform 102 such that they direct liquid into the solid wash aid area 56. In addition to supporting the spray nozzles 100, the platform 102 accommodates a spaced pair of door element catches 103.

In the present embodiment, the liquid dispensing system comprises four spray nozzles 100, and three of the spray nozzles 100, which are identified in the figures as a tri-lobe group 108, are dedicated to the tri-lobe solid bulk wash aid 92. The fourth spray nozzle, which is labeled as its own D-shaped group 110, is assigned to the D-shaped solid bulk wash aid 94. The manifold system resides beneath the platform 102 and delivers liquid from the first and second inlet conduits 104, 106, which are disposed inside the door 28 of the dishwasher 10, to the groups 108, 110, respectively, of the spray nozzles 100. A system for delivering liquid to the first and second inlet conduits 104, 106 in the door 28 is disclosed in U.S. Patent Application, entitled "Dishwasher with Water Supply to Door, which is incorporated herein by reference in its entirety, and is filed concurrently herewith.

When the first door element 70 is in the closed position, the door element catches 103 receive the inside surface of the first door element 70, and the bulk wash aid carrier 84 and, therefore, the solid bulk wash aids 92, 94 reside in the solid wash aid area 56 and above the spray nozzles 100, as depicted in FIG. 4 where the solid bulk wash aids 92, 94 are shown in phantom. The solid bulk wash aids 92, 94 align with the spray nozzles 100. Specifically, the group 108 aligns with the tri-lobe bulk wash aid 92, and the group 110 aligns with the D-shaped bulk wash aid 94. As a result of this orientation, the spray nozzles 100 in the group 108 can direct liquid through the grid 88 and onto the tri-lobe bulk wash aid 92, and, similarly, the spray nozzle 100 in the group 110 can spray liquid through the grid 88 and onto the D-shaped bulk wash aid 94.

The bulk wash aids used with the invention can comprise any wash aid suitable for use in household dishwashers. For example, the bulk wash aid, whether solid or liquid, can be a detergent, a rinse aid, a film remover, or combinations thereof. Solid wash aids can be in the form of a block made from, for example, compressed powders. The particular shape of the solid bulk wash aids and corresponding insert openings is not critical to the invention. The shape can be a square, a rectangle, a circle, an oval, a trapezoid, a parallelogram, a multi-lobe shape, or any other standard or irregular shape. If the bulk wash aid dispenser 40 is fashioned to store more than one type of solid bulk wash aid, then each individual pair of solid bulk wash aids and insert openings preferably have a unique shape.

The number of spray nozzles 100 depends on the quantity and size of bulk wash aids that can be received in the bulk wash aid carrier 84. The quantity of spray nozzles 100 in a group depends on the size of the solid bulk wash aid. Logically, large solid bulk wash aids with a large surface area require either more spray nozzles 100 or other spray nozzles capable of spraying liquid over a larger region than small solid bulk wash aids with a small surface area.

With continued reference to FIGS. 2-4, the liquid wash aid area 58 houses a wax motor 112 and a pump 114, which are operatively connected by a rod 116. The rod 116 is coupled with a diaphragm 118 on the pump 114 such that reciprocating movement of the rod 116, initiated by the wax motor 112, induces similar reciprocating motion of the diaphragm 118. The diaphragm 118 is in operative communication with an internal conduit and valve system (not shown) in the pump 114. The internal conduit and valve system has an inlet 120 comprising a nipple 122 surrounded by arcuate apertures 124 and an outlet (not shown) in the form of an elongated slot on its lower surface. The outlet is substantially parallel to the divider wall 60 and is in fluid communication with a channel 126 that extends from the rear wall 50 and through the front frame 46 of the housing 12.

A replaceable cartridge 130 containing a liquid bulk wash aid is positioned in the liquid wash aid area 58 and adjacent the pump inlet 120. The cartridge 130 has a scored seal (not shown) that mates with the nipple 120. When the cartridge 130 is not disposed on the nipple 120, the seal retains the liquid bulk wash aid inside the cartridge 130. However, when the nipple 120 perforates the seal, the liquid bulk wash aid can flow from the cartridge 130, through the apertures 124, and into the internal conduit and valve system of the pump 114.

Wax motors are well-known devices for powering pumps and other components in appliance and, therefore, the wax motor 112 has not been described in detail. It is within the scope of the invention to use another type of motor or another mechanism to drive the pump 114. Additionally, scored seals that mate with nipples are common features of replaceable containers that store and dispense liquids. While such seals are preferred, it is within the scope of the invention to utilize another type of seal suitable for a replaceable container. Furthermore, the bulk wash aid dispenser 40 shown in FIGS. 2-4 is designed to store and dispense from one cartridge 130 of liquid bulk wash aid, but the invention is not limited to storing and dispensing from one cartridge 130. The bulk wash aid dispenser 40 can accommodate more than one cartridge 130 of liquid bulk wash aid if desired.

A schematic illustration of the wash aid dispensing system is presented in FIG. 5. The controller 44 controls the pump 32 and the heater 34 of the liquid circulation system 30, the delivery of liquid through first and second valves 140, 142 of the first and second inlet conduits 104, 106, respectively, that lead to the spray nozzles 100, and the operation of the wax motor 112. The controller is in communication with a control panel 140 having a user interface preferably located on the door 28. The user selects one of several dishwashing cycles on the user interface, and the control panel 140 relays the desired dishwashing cycle information to the controller 44. In response, the controller 44 coordinates pumping and heating of liquid, dispensing of the solid bulk wash aids 92, 94 by selectively opening the first and second valves 140, 142, and dispensing of the liquid bulk wash aid from the replaceable cartridge 130 by selectively activating the wax motor 112.

The operation of the dishwasher 10 with the bulk wash aid dispenser 40 will now be described with respect to the embodiment illustrated in FIGS. 2-5. However, the general description also applies to variations of the bulk wash aid dispenser 40, for example a dispenser that stores only one solid bulk wash aid and/or more than one cartridge of liquid bulk wash aid. Furthermore, the sequence of the operation steps in the following description is for illustrative purposes and can vary without departing from the scope of the invention.

To load the bulk wash aid dispenser 40, the user moves the door 28 to the opened position and pushes on the latches 76 to pivot the first and second door elements 70, 72 about the pivot pins 74 to the opened position. The tri-lobe solid bulk wash aid 92 is inserted through the tri-lobe insert opening 96 and into the chamber 86, and, likewise the D-shaped solid bulk wash aid 94 is inserted through the D-shaped insert opening 98 and into the chamber 86 on the opposite side of the internal wall 87. Next, the replaceable cartridge 130 of liquid bulk wash aid is positioned over and pushed onto the nipple 122 of the pump inlet 120. The liquid bulk wash aid flows through the apertures 124 and into the pump 114.

It is preferred, but not required, that the solid and liquid wash aids be of different types. For exemplary purposes only, the tri-lobe solid bulk wash aid 92 is a detergent, the D-shaped solid bulk wash aid is pre-wash detergent, and the liquid bulk wash aid in the cartridge 130 is a rinse aid.

Once the solid and liquid bulk wash aids are loaded into the dispenser 40, the first and second door elements 70, 72 are pivoted about the pivot points 74 to the closed position. As the door elements 70, 72 rotate past the front frame 46, the front frame 46 exerts a force onto the latches 76 and against the bias of the spring 82 such that the ledge 80 can slide past the front frame 46. With the ledge 80 retained by the front frame 46, the latches 76 secure the first and second door elements 70, 72 in the closed position. The user then moves the door 28 to the closed position and selects the desired dishwashing cycle on the user interface of the control panel 144. For illustrative purposes only, the dishwashing cycle includes a soak cycle, a first rinse cycle without wash aid, a wash cycle, and a second rinse cycle with wash aid. The types and quantities of cycles vary according the dishwashing cycle. Examples of dishwashing cycles include normal, light/china, heavy/pots and pans, and rinse only.

The control panel 144 sends the desired dishwashing cycle information to the controller 44, which begins the desired dishwashing cycle. The liquid circulation system 30 fills the bottom of the wash tub 14 with liquid. The second valve 142 opens, and liquid flows through the second inlet conduit 106 to the spray nozzle 110. At any time during the dishwashing cycle, the heater 34 can activate to heat the liquid that is delivered to or recirculated within the wash chamber 24 or the liquid that is supplied to the bulk wash aid dispenser 40.

In general, the liquid distributed from the spray nozzles 100 dissolves and/or erodes a single charge, the amount of a wash aid required during a dishwashing cycle, from the solid bulk wash aid, and the single charge exits the solid wash aid area 56 through the clearance between the first door element 70 and the frame 46 and enters the wash chamber 24 and the liquid circulation system 30. The amount of the solid bulk wash aid in the single charge can vary according to the dishwashing cycle and the cycles in the dishwashing cycle and is a function of the quantity and pressure of the sprayed liquid and the duration for which the liquid is sprayed. These variables can be altered to produce a desired single charge or multiple charges of a predetermined amount that sum to the single charge. For example, the duration of a liquid spray can be increased to produce a larger single charge, or the liquid spray having a fixed duration can be applied multiple times until the single charge is produced. Furthermore, the entire single charge need not be dispensed all at once; rather, the single charge can be dispensed in multiple, discrete charges of predetermined amounts at various times throughout the dishwashing cycle or the individual cycles of the dishwashing cycle. Also, the amount of wash aid in a single charge can be programmed according to the dishwashing cycle, or it can be calculated during the dishwashing cycle with the aid of sensors in the liquid circulation system 30 that determine the quantity of debris in the wash chamber liquid. Furthermore, the spray nozzles 100 can dissolve/erode amounts of wash aid equal to a portion of a single charge or in excess of a single charge. In other words, the quantity of dispensed solid wash aid can be a variable amount ranging from less than a single charge, equal to a single charge, or greater than a single charge. The spray nozzles 100 can accurately dispense any reasonable amount of solid wash aid at any time during a dishwashing cycle. In the current description, for exemplary purposes only, the amount of wash aid dispensed from each solid bulk wash aid is a single charge.

Liquid is sprayed from the spray nozzle 110 onto the D-shaped solid bulk wash aid 94 to produce a single charge of pre-wash detergent. After the single charge is produced, the controller 44 closes the second valve 142. The single charge flows from the bulk wash aid dispenser 40, through the clearance between the first door element 70 and the frame 46, and into the wash chamber 24, where it mixes with the liquid in the bottom of the wash tub 14. The pump 32 pumps the liquid/pre-wash detergent mixture up through the spray arms 26, which distributes the mixture throughout the wash chamber 24. The dishwasher 10 pauses for a predetermined amount of time so that the mixture can soak on the utensils to remove large deposits of food or other material from the utensils.

Once the soak cycle is completed, the liquid mixture in the wash chamber 24 is drained, the liquid circulation system 30 fills the bottom of the wash tub 14 with fresh liquid, which is distributed throughout the wash chamber to rinse the utensils for the first rinse cycle.

Next, the rinse liquid in the wash chamber 24 is drained, and the liquid circulation system 30 fills the bottom of the wash tub 14 with fresh liquid for the wash cycle. The controller 44 opens the first valve 140, and liquid flows through the first inlet conduit 104 to the group 108 of spray nozzles 100. Liquid sprayed onto the tri-lobe solid bulk wash aid 92 produces a single charge of detergent in a manner similar to the production of the single charge of pre-wash detergent from the D-shaped solid bulk wash aid 94. After the single charge of detergent is created, the controller 44 closes the first valve 140. The detergent flows from the bulk wash aid dispenser 40, through the clearance between the first door element 70 and the frame 46, and into the wash chamber 24, where it mixes with the liquid in the bottom of the wash tub 14. The pump 32 pumps the liquid/detergent mixture up through the spray arms 26, which distributes the mixture throughout the wash chamber 24. The liquid/detergent mixture can be recirculated several times, depending on the protocol of the wash cycle. Once the wash cycle is complete, the liquid/detergent mixture is drained from the wash tub 14.

To begin the second rinse cycle, fresh liquid fills the bottom of the wash tub 14, and the controller 44 activates the wax motor 112. The wax motor 112 induces reciprocating movement of the rod 116, which consequently moves the diaphragm 118. Reciprocating movement of the diaphragm 118 pumps the rinse aid through the internal conduit and valve system of the pump 114. Upward motion of the diaphragm 118 draws the liquid bulk wash aid through any upstream valves, while downward motion of the diaphragm 118 forces the liquid bulk wash aid through any downstream valves and through the outlet. Once the single charge of rinse aid is produced, the controller 44 deactivates the wax motor 112.

The amount of the liquid bulk wash aid in the single charge can vary according to the dishwashing cycle and the cycles in the dishwashing cycle and is a function of the power and speed of the wax motor 112 and the duration for which the wax motor 112 is activated. These variables can be altered to produce a desired single charge or multiple charges of a predetermined amount that sum to the single charge. For example, the wax motor can run for a longer period of time to produce a larger single charge, or the wax motor 112 can run multiple times until the single charge has been produced. Furthermore, the entire single charge need not be dispensed all at once; rather, the single charge can be dispensed in multiple, discrete charges of predetermined amounts at various times throughout the dishwashing cycle or the individual cycles within the dishwashing cycle. Also, the amount of wash aid in a single charge can be programmed according to the dishwashing cycle, or it can be calculated during the dishwashing cycle with the aid of sensors in the liquid circulation system 30. Furthermore, the wax motor 112 can produce amounts of wash aid equal to a portion of a single charge or in excess of a single charge. In other words, the quantity of dispensed liquid wash aid can be a variable amount ranging from less than a single charge, equal to a single charge, or greater than a single charge. The wax motor 112 can accurately dispense any reasonable amount of liquid wash aid at any time during a dishwashing cycle. In the current description, for exemplary purposes only, the amount of wash aid dispensed from the liquid bulk wash aid is a single charge The single charge of rinse aid flows from the outlet to the channel 126, where it is subsequently released into the wash chamber 24 and mixes with the liquid in the bottom of the wash tub 14. The pump 32 and the spray arms 26 distribute the liquid/rinse aid mixture throughout the wash chamber 24 to remove any residual detergent or debris from the utensils. Upon completion of the rinse cycle, the liquid/rinse aid mixture is drained from the wash tub 14, and the user can move the door 28 to the opened position.

When the door 28 is in the opened position, the user can look through the windows 91 to determine whether the solid bulk wash aids 92, 94 require replacement. Alternatively, the aforementioned visual or audio signal can notify the user, even when the door 28 is in the closed position, that replacement is required. If either or both of the solid bulk wash aids 92, 94 are completely consumed, a replacement solid bulk wash aid can be inserted into the bulk wash aid dispenser as described above. If the cartridge 130 requires replacement, it is removed from the nipple 122, and a new cartridge is positioned over the nipple 122 as described earlier.

In the above description of the operation of the dishwasher 10 with the bulk wash aid dispenser 40, the solid bulk wash aids 92, 94 and the liquid bulk wash aid in the cartridge 130 are dispensed individually during the dishwashing cycle. However, it is within the scope of the invention for simultaneous dispensing of a solid bulk wash aid and a liquid bulk wash aid, more than one solid bulk wash aid, more than one liquid bulk wash aid, or various combinations of multiple solid and liquid bulk wash aids. To accomplish simultaneous dispensing, the controller 44 simply simultaneously opens more than one valve 140, 142 and/or activates more than one wax motor 112.

Figure 6:
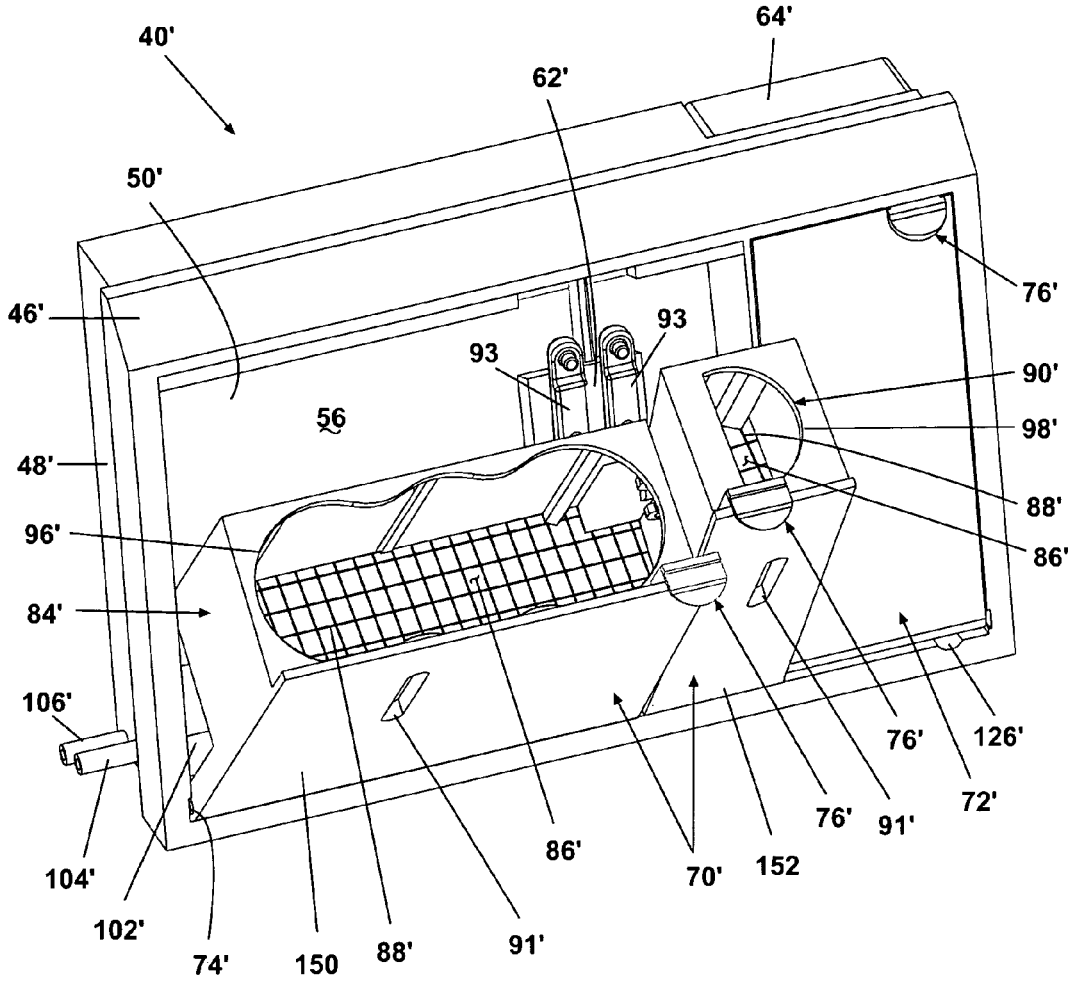
FIG. 6 is a front elevational view of an alternative embodiment of a bulk wash aid dispenser similar to the bulk wash aid dispenser from FIG.2, except that the door element covering the solid wash aid area comprises two door components, each having a bulk wash aid carrier, wherein one of the bulk wash aid carriers has a tri-lobe insert opening and the other bulk wash aid carrier has a D-shaped insert opening.

A second embodiment of a bulk wash aid dispenser 40' is illustrated in FIG. 6, where like objects are identified with the same reference numeral bearing a prime (') symbol. The second embodiment is identical to the first embodiment, except that the first door element 70' is split into a first door component 150 and a second door component 152, each of which have a bulk wash aid carrier 84' that defines a chamber 86' for holding a single solid bulk wash aid. Each bulk wash aid carrier 84' has an insert opening 90' that serves as a key to ensure that the solid bulk wash aids are inserted into the correct chamber 86'. For exemplary purposes, the bulk wash aid carrier 84' on the first door component 150 has a tri-lobe insert opening 96', and the bulk wash aid carrier 84' on the second door component 152 comprises a D-shaped insert opening 98'. The operation of the second embodiment of the bulk wash aid dispenser 40' is substantially the same as that of the first.

The bulk wash aid dispenser 40 or other embodiments thereof according to the invention accurately dispenses a controllable amount, usually a single charge, of wash aid into the wash chamber 24 of the dishwasher 10 at predetermined times during the selected dishwashing cycle. The controllable amounts of wash aid can be released into the wash chamber 24 all at once or in selected intervals to effect efficient cleaning of the utensils. The controller 44 of the bulk wash aid dispenser 40 can be programmed to manage the dispensing of different types of wash aids during various dishwashing cycles and the individual cycles of the dishwashing cycle.

The bulk wash aid dispenser 40 is able to store both solid and liquid bulk wash aids and dispense single charges therefrom. To ensure that the correct solid bulk wash aid is inserted into the proper location in the dispenser 40, the bulk wash aid carrier 84 has insert openings 90 of differing predetermined shapes that correspond to the differing predetermined shapes of the solid bulk wash aids. This system guarantees that the appropriate solid bulk wash aid is dispensed at the correct time during the selected dishwashing cycle. The liquid bulk wash aids are housed in a convenient, replaceable cartridge 130 that is easily coupled with and removed from the pump 114 in the dispenser 40. The bulk wash aid dispenser 40 also offers the flexibility of being able to simultaneously dispense multiple wash aids, whether solid or liquid, during the dishwashing cycle.

While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic household dishwasher for washing utensils in accordance with a user selected dishwashing cycle, comprising:

a wash tub having top, bottom, side and rear walls, with the walls collectively forming an open-faced wash chamber for receiving utensils to be washed;

a moveably mounted door movable between an opened position for providing access to the wash chamber, and a closed position for selectively closing the open-face of the wash chamber during the dishwashing cycle;

a bulk wash aid dispenser mounted to an interior surface of the door for storing a supply of solid wash aid greater than that needed for a single dishwashing cycle;

a fluid conduit in the door and in fluid communication with a spray nozzle, the spray nozzle mounted near a bottom wall of the bulk wash aid dispenser;

a grid for supporting the supply of solid wash aid above the spray nozzle; and wherein a fluid is delivered from the spray nozzle, through the grid and onto the solid wash aid for dissolving an amount of wash aid required for the single dishwashing cycle.

2. The automatic household dishwasher according to claim 1 wherein the bulk wash aid dispenser dispenses a variable amount of wash aid depending on the dishwashing cycle selected by the user.

3. The automatic household dishwasher according to claim 2 wherein the bulk wash aid dispenser dispenses the variable amount of wash aid in multiple charges of a predetermined amount.

4. The automatic household dishwasher according to claim 3 wherein the multiple charges are dispensed at different times throughout the dishwashing cycle.

5. The automatic household dishwasher according to claim 4 and further comprising a controller for executing the selected dishwashing cycle end controlling the dispensing of the multiple charges in response to the selected dishwashing cycle.

6. The automatic household dishwasher according to claim 5 wherein the controller comprises a user interface through which a user can select one of several dishwashing cycles.

7. The automatic household dishwasher according to claim 1 wherein the bulk wash aid dispenser dispenses multiple wash aids.

8. The automatic household dishwasher according to claim 7 wherein at least one of the multiple wash aids is a liquid.

9. The automatic household dishwasher according to claim 7 wherein the multiple wash aids include a solid wash aid and a liquid wash aid.

10. The automatic household dishwasher according to claim 1 wherein the bulk wash aid dispenser comprises a solid wash aid chamber for storing a solid wash aid.

11. The automatic household dishwasher according to claim 10 wherein the solid wash aid chamber is keyed to receive a predetermined solid wash aid.

12. The automatic household dishwasher according to claim 11 wherein the solid wash aid chamber has an insert opening of a predetermined shape to form the keyed chamber.

13. The automatic household dishwasher according to claim 12 wherein the insert opening is one of a tri-lobe and a D-shape configuration.

14. The automatic household dishwasher according to claim 1 wherein the bulk wash aid dispenser comprises a liquid wash aid area for storing a liquid wash aid.

15. The automatic household dishwasher according to claim 14 wherein the liquid wash aid area comprises a replaceable cartridge containing the liquid wash aid.

16. The automatic household dishwasher according to claim 15 wherein the liquid wash aid area comprises a pump fluidly connected to the replaceable cartridge for pumping the liquid wash aid from the replaceable cartridge into the wash chamber.

17. The automatic household dishwasher according to claim 1 wherein the bulk wash aid dispenser comprises a housing mounted to an inner surface of the door and defining a bulk wash aid storage area, and a dispenser door moveably mounted to the housing for selectively closing the bulk wash aid storage area.

18. The automatic household dishwasher according to claim 17 and further comprising a bulk wash aid carrier mounted to an inner surface of the dispenser door and defining a chamber for receiving a bulk supply of wash aid.

19. The automatic household dishwasher according to claim 18 wherein the spray nozzle is located within the housing to direct liquid spray into the chamber to effect the dispensing of the bulk wash aid stored therein.

20. The automatic household dishwasher according to claim 18 wherein the carrier comprises an insert opening of a predetermined shape to permit the insertion of a bulk supply of wash aid having a configuration corresponding to the predetermined shape of the insert opening.

21. The automatic household dishwasher according to claim 20 wherein the insert opening is one of a tri-lobe and a D-shape configuration.

22. The automatic household dishwasher according to claim 21 wherein the bulk wash aid carrier comprises a second insert opening having a second predetermined shape.

23. The automatic household dishwasher according to claim 20 and further comprising a cartridge containing a bulk supply of liquid wash aid, with the cartridge being placed within the bulk wash aid storage area.

24. The automatic household dishwasher according to claim 23 and further comprising a pump fluidly coupled to the cartridge for dispensing the liquid wash aid from the cartridge.

25. A bulk wash aid dispenser for an automatic household dishwasher for washing utensils in accordance with a user selected dishwashing cycle, comprising:

a housing defining a bulk wash aid storage area;

a dispenser door moveably mounted to the housing moveable between an opened position and a closed position for selectively closing the bulk wash aid storage area;

a bulk wash aid carrier mounted to an inner surface of the dispenser door and defining a chamber having a grid for supporting a bulk supply of solid wash aid, the chamber being accessible when the dispenser door is in the open position to permit the filling of the chamber with the solid wash aid;

wherein to bulk wash aid dispenser stores a supply of wash aid greater than that needed for a single dishwashing cycle in the chamber; and a spray nozzle located within the housing to direct liquid spray into the chamber to effect the dispensing of an amount of wash aid required for the single dishwashing cycle.

26. The bulk wash aid dispenser according to claim 25 wherein the bulk wash aid carrier comprises an insert opening of a predetermined shape to permit the insertion of a bulk supply of wash aid having a configuration corresponding to the predetermined shape of the insert opening.

27. The bulk wash aid dispenser according to claim 26 wherein the insert opening is one of a tri-lobe or a D-shape configuration.

28. The bulk wash aid dispenser according to claim 26 wherein the bulk wash aid carrier comprises a second insert opening having of a second predetermined shape.

29. The bulk wash aid dispenser according to claim 25 and further comprising a cartridge containing a bulk supply of liquid wash aid, with the cartridge being placed within the bulk wash aid storage area.

30. The bulk wash aid dispenser according to claim 29 and further comprising a pump fluidly coupled to the cartridge for dispensing the liquid wash aid from the cartridge.

31. The bulk wash aid dispenser according to claim 30 wherein the bulk storage area is divided into a solid wash aid area and a liquid wash aid area.

32. The bulk wash aid dispenser according to claim 31 wherein the spray nozzle located in the solid wash aid area and the pump is located in the liquid wash aid area.

33. The bulk wash aid dispenser according to claim 31 wherein the dispenser door comprises a first door element for selectively covering the solid wash aid area and a second door element for selectively covering the liquid wash aid area.

34. The bulk wash aid dispenser according to claim 25 and further comprising a cartridge containing a bulk supply of liquid wash aid, with the cartridge being placed within the bulk wash aid storage area.

35. The bulk wash aid dispenser according to claim 34 and further comprising a pump fluidly coupled to the cartridge for dispensing the liquid wash aid from the cartridge.

36. The bulk wash aid dispenser according to claim 25, wherein when the dispenser door is in the closed position, the grid and the solid wash aid is positioned above the spray nozzle.

37. The bulk wash aid dispenser according to claim 36, wherein the liquid spray is directed through the grid and onto the solid wash aid to dissolve the amount of wash aid required for the single dishwashing cycle.

* * * * *